US005358330A

United States Patent [19]

Moll

[11] Patent Number: 5,358,330

[45] Date of Patent: Oct. 25, 1994

[54] MANUAL INGREDIENT BLENDING APPARATUS FOR FOOD PREPARATION

[76] Inventor: Donald Moll, 14613 Locust, Olathe, Kans. 66062

[21] Appl. No.: 127,160

[22] Filed: Sep. 27, 1993

[51] Int. Cl.[5] ..... B01F 9/00

[52] U.S. Cl. ..... 366/130; 206/221; 215/DIG. 8

[58] Field of Search ..... 206/221, 219; 215/11.1, 215/11.6, DIG. 8; 220/23.83, 501; 366/129, 130, 348, 349, 53

[56] References Cited

U.S. PATENT DOCUMENTS

| | | | |
|---|---|---|---|
| 1,878,924 | 9/1932 | Will | 366/130 |
| 2,592,485 | 4/1952 | Stair | 366/130 |
| 3,677,524 | 7/1972 | Douglas | 366/130 |
| 4,003,555 | 1/1977 | Swartz | 366/130 |
| 4,784,949 | 3/1957 | Dennon | 366/130 |

*Primary Examiner*—Robert W. Jenkins
*Attorney, Agent, or Firm*—Lawhorn, Simpson & Polsley

[57] ABSTRACT

A manually operated ingredient blending apparatus for mixing and blending selected quantities of ingredients in a quantity suitable for use in a residential kitchen environment, especially for pastries and similar goods, where the selected quantity of ingredients permits the preparation of finished goods useful in a non-commercial quantity, the apparatus including preferably two containers with adjustable blending screens having a variable aspect with respect to each other to controllably adjust the blending and mixing of the ingredients placed in the apparatus.

4 Claims, 1 Drawing Sheet

MANUAL INGREDIENT BLENDING APPARATUS FOR FOOD PREPARATION

TECHNICAL FIELD

This invention generally pertains to food preparation apparatus, and more particularly to apparatus and equipment for mixing and blending ingredients to be incorporated in non-commercial foods.

BACKGROUND ART

There are various means, as well as various methods, of mixing, combining or blending the several ingredients which are typically employed in the preparation of foodstuffs. The typical means of blending ingredients includes a bowl and a mixing means such as the generally well-known mechanical mixer, equipped with one or more beaters for extending into the interior of the bowl and mixing or combining any substances contained in the bowl. Mechanical mixers may be motor driven, typically by electric motors which drive the beater elements by way of a gear train, or may be manually operated to drive the beater elements by way of a hand-crank operated gear train.

Alternatively, the blending of substances in a mixing bowl may be accomplished manually by the use of hand tools. There are a number of hand tools suitable for use as a mixing means. Spoons and whisks are examples of hand held mixing tools suitable for mixing and blending ingredients in food preparation.

The typical method of combining such ingredients includes the steps of selecting a suitable mixing bowl or container, placing a selected quantity of a first selected ingredient in interior of the mixing bowl, placing a selected quantity of a second selected ingredient in the interior of the mixing bowl, inserting a mixing means into the interior of the mixing bowl and operating the mixing means to mix and blend the first and second ingredients. Since more than two ingredients are typically required for the preparation of a given foodstuff, a selected quantity of a third selected ingredient is then placed in the interior of the mixing bowl and the mixing means is again operated to mix and blend the ingredients contained in the mixing bowl interior. This step is then repeated for the necessary number of iterations to include the fourth ingredient, and the fifth, and so on, as required to obtain a dough or batter having the desired consistency and composition.

The desired quantity of ingredients is usually selected from a list of instructions, commonly known as a recipe, which identifies the ingredients to be used. These ingredients may typically include milk, eggs, flour and sugar. Some of these ingredients, such as milk and eggs, are highly perishable and have an extremely limited useful life, and may be utilized within a relatively short period of time. Other ingredients, such as flour and sugar, may be stored for an extended period for use at a convenient time. However, it is only possible to make a successful combination of ingredients within the useful life time of the perishable ingredients.

This limitation presents several disadvantages. First of all, it requires that the preparation of a food item be time limited, with all ingredients being measured, added and mixed in a single operation. This often represents an extremely untidy situation, entailing substantial cleanup and work on the part of the preparer. Secondly, since some ingredients contain substantial moisture and others are granular or relatively dry, it is difficult to obtain a regular and even mix of ingredients. Typically, it is very difficult to avoid irregular agglomerations of unevenly mixed quantities of ingredients, which render the blend of ingredients "lumpy". Substantial work is usually required to avoid this problem. In addition, the mixture obtained is often relatively firm, whereas it is desirable to obtain at least a certain degree of what may best be termed "fluffiness", a proportion of air blended into the mixture so as to create miniscule air bubbles in the mixture. This substantially improves the texture of the finished food product, but is typically obtained in the desired degree only irregularly. Thirdly, food preparation in this manner is relatively time-consuming.

Therefore, it is an object of the present invention to provide a mixing apparatus whereby preparation of at least some foodstuffs may be completed in an efficient manner, with minimal unnecessary time consumption.

It is another object of the present invention to provide a mixing apparatus whereby an even and regular mixing and blending of selected ingredients is regularly obtained.

It is a further object of the present invention to provide a mixing apparatus which will permit the pre-mixing of dry ingredients.

It is yet a further object of the present invention to provide a mixing apparatus which will permit the ready storage of selected quantities of pre-mixed ingredients.

It is yet another object of the present invention to provide such a mixing apparatus as may be suitably employed in the mixing of various combinations of selected ingredients.

It is a further object of the present invention to provide such a mixing apparatus as will provide a desired proportion of air mixed into the mixture and an improved fluffiness of the mixture.

It is a further object of the present invent ion to provide such a mixing apparatus as is simple in operation and usage.

It is yet a further object of the present invention to provide such a mixing apparatus as is easily manufactured.

It is yet another object of the present invention to provide such a mixing apparatus as is inexpensive to manufacture and use.

It is another object of the present invention to provide such a mixing apparatus as is readily and easily cleaned for re-use.

These and other objectives of the present invention will become apparent in the specification and claims that follow.

SUMMARY OF THE INVENTION

The subject invention is a blending apparatus for mixing and blending the relatively dry and granular ingredients typically employed in the preparation of foods. The blending apparatus enables a user to pre-mix selected quantities of ingredients, and to store these ingredients for use at a later time. According to the preferred embodiment, the blending apparatus includes a container having two mutually opposed parts. Between these container parts is a mixing screen assembly with at least two relatively adjustable screen elements for controllably varying the mixing and blending of ingredients. These containers may be selectively separated from one another and the screen assembly removed, if desired, to permit the use of one or both of the containers as storage containers for the mixed ingredients. According to an alternative embodiment, the mixing screen assembly may be provided on a closure member which may be temporarily affixed to a container for mixing and blending ingredients therein.

DESCRIPTION OF THE PREFERRED EMBODIMENT

Figure 1:
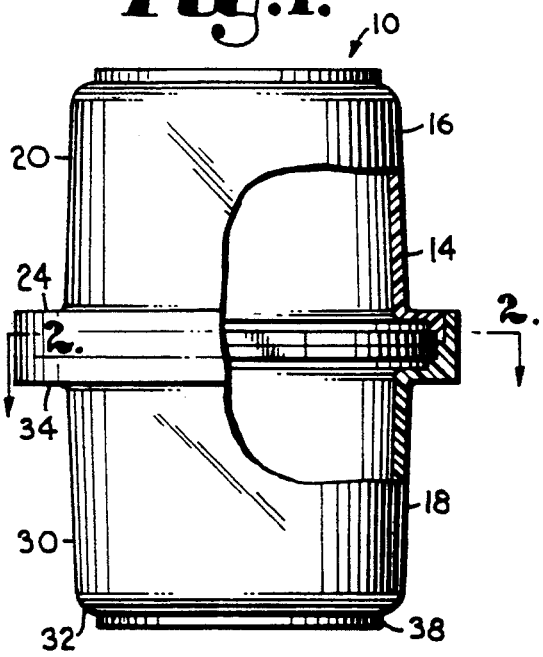
FIG. 1 shows a side view, including a partial cross-sectional view, of a blending apparatus according to the present invention.

An ingredient mixing and blending apparatus useful in food preparation generally according to the present invention is shown in FIG. 1 and referred to with reference number 10. For purposes of description, the blending apparatus 10 is described in accord with the attitude shown in drawing FIG. 1, and "top", "bottom", "horizontal", "vertical", and so forth are to be so understood. However, those skilled in the art will recognize that the apparatus 10 will not be in that attitude at all times, and such terms are not intended to be limiting.

The blending apparatus 10 includes a bifurcated, preferably transparent container 14 having a top portion 16 and a bottom portion 18. The top portion 16 includes a top portion sidewall 20, a top portion first end 22 and a top portion second end 24. The top portion first end 22 is preferably circular and substantially flat, forming the upper end of the bifurcated container 14. An annular bumper ring 28 of slightly smaller diameter than the top portion first end 22 is disposed on the outer surface of the top portion first end 22 for supporting the blending apparatus 10 on a generally level surface when the top-bottom attitude of the mixing apparatus 10 is reversed.

The bottom portion 18 similarly includes a bottom portion sidewall 30, a bottom portion first end 32 and a top portion second end 34. As with the top portion 16, the bottom portion first end 32 is preferably circular and substantially flat, forming the lower end of the bifurcated container 14. An annular bottom bumper ring 38 of slightly smaller diameter than the bottom portion first end 32 is disposed on the outer surface of the bottom portion first end 32 for supporting the mixing apparatus 10 on a generally level surface.

Preferably, the top portion sidewall 20 and bottom portion sidewall 30 are frusto-conical, being wider at their respective first ends than at their respective second ends. As seen in FIG. 1, the angle of the sidewalls 20 and 30 with respect to the vertical is very small, on the order of 2 to 5 degrees from the vertical, for example.

Figure 2:
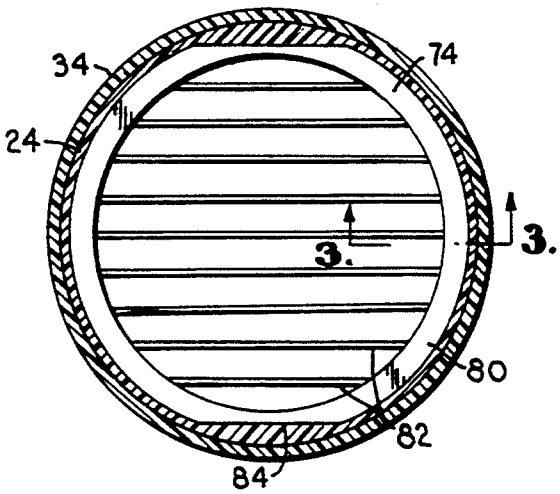
FIG. 2 shows a cross-sectional view of the blending apparatus as shown in FIG. 1 taken along the Section lines 2—2 of FIG. 1.
Figure 3A:
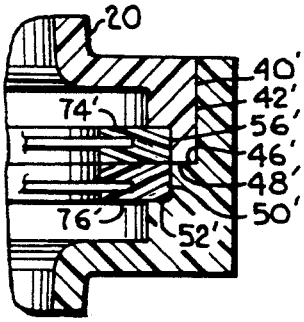
FIG. 3A shows an enlarged, partial cross-sectional view of an alternative embodiment of the blending apparatus as shown in FIG. 3 taken along the Section lines 3—3 of FIG. 2.
Figure 3:
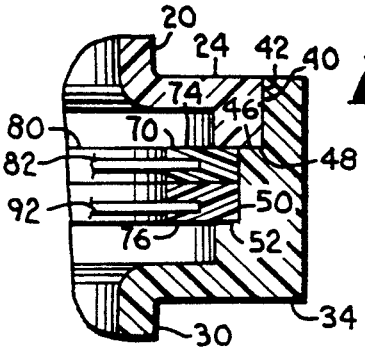
FIG. 3 shows an enlarged, partial cross-sectional view of the blending apparatus as shown in FIG. 1 taken along the Section lines 3—3 of FIG. 2.

Turning now more particularly to FIGS. 1 through 3, the respective second end portions 24 and 34 are discussed in greater detail. The top portion second end 24 includes a top end outer or first engagement surface 40 which is cylindrical and of a diameter E. This first engagement surface 40 is maintained in a secure, selectively disengageable connection with a bottom end outer or second engagement surface 42 which is also cylindrical and of a diameter E1. The diameter E of the first engagement surface 40 and the diameter E1 of the second engagement surface 42 are sized to provide an interference fit between the respective first and second engagement surfaces 40 and 42 whereby the top and bottom portions 16 and 18 of the bifurcated container 14 are secured together. Preferably, the mating of the first and second engagement surfaces 40 and 42 also provide a seal which is proof against the passage of granular material. The seal formed by the first and second engagement surfaces 40 and 42 may also be a fluid-tight seal, if desired.

An annular, horizontal top portion first stop surface 46 on the end of the first engagement surface 40 abuts an annular first shoulder 48 in the bottom portion second end 34. This engagement limits the depth of engagement between the first and second engagement surfaces 40 and 42.

At the radially inner end of the first shoulder 48 is a vertical, cylindrical screen retainer surface 50. The height of the screen retainer surface 50 is limited by an annular screen stop shoulder 52, which is a horizontal surface extending radially inwardly from the screen retainer surfaces 50.

The top portion stop surface 46, the screen retainer surface 50 and the annular screen stop shoulder, form an annular groove in which a mixing screen assembly 70 is disposed. The mixing screen assembly 70 includes a first screen element 74 and a second screen element 76.

The first screen element 74 includes a first screen mounting ring 80 and at least one first blending element 82. The first screen mounting ring 80 is a relatively thin ring of rectangular cross-section. The first blending element 82 extends across the open center of the mounting ring 80 in the same manner as a chord of a circle. Preferably, of course, a plurality of first blending elements 82 are incorporated in the first screen element 74. Each first blending element 82 is a rod of relatively small diameter, for example, a metal wire of stainless steel of relatively small gauge. The first blending elements 82 are secured in the mounting ring 80 in a horizontally planar, parallel and spaced apart arrangement. The relative spacing of the first blending elements 82 need not be the same for each screen element 74 or 76. An exemplary blending first element 82 spacing would provide ½ inch between each of the adjacent first blending elements 82 in a mounting ring 80 having an inner diameter of 4 inches and an outer diameter of 4 ½ inches.

However, a bar could be employed as the first blending element 82 in place of a rod, where the bar has a relatively small horizontal width. Where a bar is selected as the first blending element 82, a suitable bar could have a greater vertical dimension than the horizontal dimension, which would contribute to the strength of the first blending element 82. Furthermore, the first blending elements 82 and the first screen mounting ring 80 could be a unitized or one-piece molded component.

Those skilled in the relevant art will recognize that the cited spacing of ½ inch between the next adjacent blending elements 82 can also be altered without materially altering the nature of the subject invention. The spacing between the next adjacent blending elements 82 could be reduced between each next adjacent blending element 82, for example, from $\frac{5}{8}$ inch to $\frac{3}{8}$ inch. Alternatively, the spacing between each of the next adjacent blending elements 82 may be randomly varied, for example, from $\frac{5}{8}$ inch to $\frac{3}{8}$ inch.

The first screen element 74 also includes two opposed flat vertical access surfaces 84 in the form of chords taken from the outer diameter of the first screen mounting ring 80. The access surfaces 84 defined by the chords do not intersect the inner diameter of the mounting ring 80. These access surfaces 84 permit occasional, selective access to the mounting ring 80 when it is desired to alter the rotational position of the mounting ring 74 or to remove the first screen element 74 from the top portion 24.

The second screen element 76 is substantially identical to the first screen element, having a second screen mounting ring 90 and at least one second blending element 92. As with the first screen element 74, a plurality of parallel, spaced apart second blending elements 92 is preferably included so as to provide suitable blending capability in the blending apparatus 10. The second screen element 76 need not be identical to the first screen element 74, and alternative blending element spacings and conformations may be utilized in each screen element.

The first and second screen element 74 or 76 are rotationally secured in the blending apparatus 10 with an interference fit which may be overcome by a relatively light pressure to rotate the position of the selected screen element 74 or 76, or to remove a selected screen element 74 or 76. Access to either the first or second screen element 74 or 76 can only be had when the top portion 16 and the bottom portion 18 are separated from each other. The interference fit of the mounting rings 80 and 90 may be with the stop surface 46 and the screen stop shoulder 52 in the manner of a compression fit, or may be between the mounting rings 80 and 90 and the screen retainer surface 50.

Preferably, the components of the blending apparatus 10 is formed from plastic so as to minimize expense of manufacture, although the blending elements 82 and 92 may be formed from metal rods. The other components of the blending apparatus 10 may also be formed of steel or other metal.

In operation, the blending apparatus 10 is disassembled by the user. The top portion 16 of the container 14 is separated from the bottom portion 18 by gripping the respective top and bottom sidewalls 20 and 30, and applying sufficient force to overcome the interference fit between the first engagement surface 40 and the second engagement surface 42. The first and second screen elements 74 and 76 are then removed from the bottom portion second end 34. Ingredients to be mixed or blended may then be added in measured quantities to the bottom portion 18.

After the desired ingredients are added to the bottom portion 18, the second screen element 76 is placed adjacent the screen retainer surface 50 to rest on the screen stop shoulder 52. The first screen element 74 is then placed immediately adjacent and resting on the second screen element 76 and adjacent the screen retainer surface 50. The first and second screen elements 74 and 76 are then rotated relative each other to a position wherein the blending elements 82 of the first screen element 74 are parallel to the blending elements 92 of the second screen element 76, defined as 0 degrees, or to a position wherein the first blending elements 82 of the first screen element 74 are perpendicular to the second blending elements 92 of the second screen element 76, defined as 90 degrees. The relative position of the first and second blending elements 82 and 92 determines the relative coarseness or fineness of the resulting blend.

When the desired blend setting has been selected, the top portion 16 is secured to the bottom portion by engaging the first and second engagement surfaces 40 and 42. The user then lifts the container and shakes the container in a relatively rapid up and down cycle, forcing the ingredients to traverse from the bottom portion 18 of the container to the top portion 16 and back again as the cycle continues. This action in turn forces the ingredients to pass through the apertures defined by the first and second blending elements 82 and 92, which in turn mixes and blends the ingredients.

During the mixing process, the ingredients also pass through the air inside the container 14. This causes the ingredients to incorporate into the mixture an amount of air in the form of miniscule air bubbles. By incorporating air, the texture of the mixture, and any food product employing any portion of the mixture, is substantially improved in texture and taste. The amount of air so incorporated will depend upon the type and nature of ingredients being mixed. However, the resulting mixture will include substantially the same amount of air each time the mixture of the selected ingredients is prepared. This permits a desired repeatability of results by the user which cannot otherwise be obtained by previous mixing methods.

Upon completion of the blending cycle, the container may be inverted to cause the blended ingredients to settle in the top portion 16, and the bottom portion 18 may be disengaged therefrom. A cover (not shown) may be placed on the second end 24 of the top portion 16 to permit storage of the blended ingredients. Preferably, the top portion 16 will be a standardized container, so that the user will have access to a plurality of these containers. This permits the user to prepare and store a number of containers having blended ingredients in the desired amount for later use, leading to substantial time savings for the user.

There are alternative embodiments of the subject invention which may be devised within the scope and spirit of the description and following claims. It should be noted that when the same item or feature is shown in more than one embodiment, it will be labeled with the corresponding reference numeral to aid in the understanding of the subject invention. Furthermore, reference should be had to all of the Figures necessary to aid in the understanding of the specification even where a particular Figure is referred to, as all reference numerals are not displayed in all Figures in order to minimize confusion and aid in clarifying the subject invention.

FIG. 3A discloses an alternative embodiment of the respective second end portions 24' and 34', indicated by reference numerals including a single prime.

The top portion second end 24' includes a top end outer or first engagement surface 40' which is cylindrical and of a diameter E'. This first engagement surface 40' is maintained in a secure, selectively disengageable connection with a bottom end outer or second engagement surface 42' which is also cylindrical and of a diameter E1'. The diameter E' of the first engagement surface 40' and the diameter E1' of the second engagement surface 42′ are sized to provide an interference fit between the respective first and second engagement surfaces 40′ and 42′ whereby the top and bottom portions 16′ and 18′ of the bifurcated container 14′ are secured together. Preferably, the mating of the first and second engagement surfaces 40′ and 42′ also provide a seal which is proof against the passage of granular material. The seal formed by the first and second engagement surfaces 40′ and 42′ may also be a fluid-tight seal, if desired.

An annular, horizontal top portion first stop surface 46′ on the end of the first engagement surface 40′ abuts an annular first shoulder 48′ in the bottom portion second end 34′. This engagement limits the depth of engagement between the first and second engagement surfaces 40′ and 42′.

At the radially inner end of the first shoulder 48′ is a vertical, cylindrical lower screen retainer surface 50′. The height of the lower screen retainer surface 50′ is limited by an annular screen stop shoulder 52′, which is a horizontal surface extending radially inwardly from the lower screen retainer surfaces 50′.

The screen retainer surface 50′ and the annular bottom screen stop shoulder 52′ form an annular groove in which second screen element 76′ is disposed.

A vertical, cylindrical upper screen retainer surface 56′ extends upwardly from the first stop surface 46′ and joins a horizontal, annular upper screen stop shoulder 58′. The upper screen retainer surface 56′ and the upper screen stop shoulder 58′ together form an annular groove in which the first screen element 74′ is disposed. Preferably, the lower screen retainer surface 50′ and the upper screen retainer surface 56′ are dimensioned to place the first and second screen elements 74′ and 76′ in sliding engagement.

In operation, the first alternative embodiment is generally identical with that of the preferred embodiment. However, the first screen element 74′ is disposed in the top container portion 16 and the second screen element 76′ is disposed in the bottom container portion 18 prior to placing the respective container portions 16 and 18 into engagement to complete the container 14. Furthermore, the relative rotational position of the first and second screen elements 74′ and 76′ may be altered by rotating the relative positions of the top container portion 16 relative to that of the bottom container portion 18. In this embodiment, the first screen element 74 is secured to the top container portion 16, and the second screen element 76 is secured to the bottom container portion 18, permitting internal screen element position to be controlled externally. Therefore, the screen elements 74′ and 76′ can be rotated to selectively form an infinite variety of apertures. This permits the user to select the texture of the mixture during the blending cycle without interrupting the cycle to open the container 14 and readjust the positions of the first and second screens 74 and 76.

Figure 4:
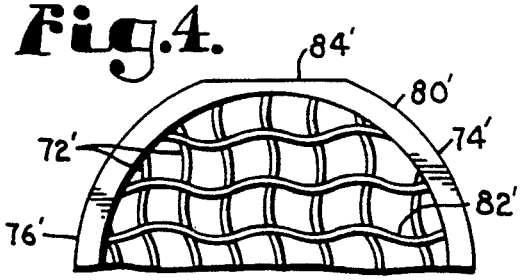
FIG. 4 shows a partial view of the mixing screen assembly according to the present invention.

A second alternative embodiment, of the first and second screen elements 74″ and 76″, is shown in FIG. 4. A double prime is added to the reference numerals of the second alternative embodiment.

According to the alternative embodiment of the first and second screen elements 74″ and 76″, each of the first screen and second screen blending elements 82″ and 92″ are horizontally planar and are provided with a wave configuration best characterized as a sine wave. The first and second screen elements 74″ and 76″ are shown rotated 90 degrees with respect to each other so as to dispose the first screen blending elements 82″ substantially perpendicularly with respect to the second screen blending elements 92″.

In operation, the blending apparatus 10 is employed in substantially the same manner as the preferred embodiment. The selection of the preferred embodiment of the first and second screen elements 74 and 76 or one or more of the alternative embodiments of the first and second screen elements 74″ and 76″ will not affect the usage of the blending apparatus 10. Rather, the selection of the suitable screen element will depend upon the desired amount of blending to be obtained.

Figure 5:
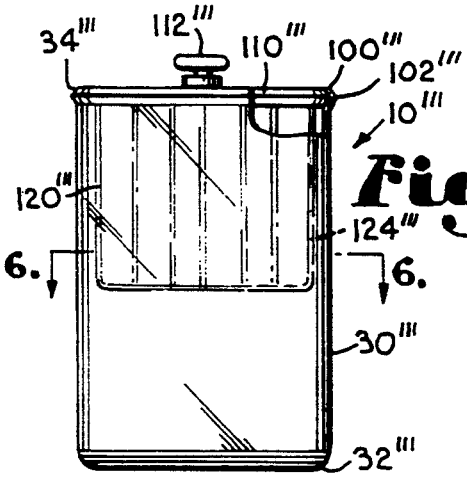
FIG. 5 shows an alternative embodiment of the blending apparatus according to the present invention.
Figure 6:
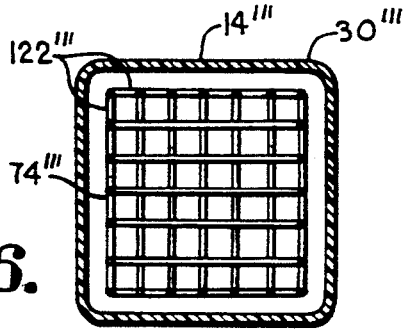
FIG. 6 shows a cross-sectional view of the blending apparatus as shown in FIG. 5 taken along the Section lines 6—6 of FIG. 5.

Another alternative embodiment of the blending apparatus 10‴ is shown in FIGS. 5 and 6. A triple prime is added to the reference numerals referring to this alternative embodiment. The blending apparatus 10‴, as shown in FIG. 5, includes a container 14‴ having a cylindrical sidewall 30‴, a first or bottom end 32‴, and a second or top end 34‴. As with the preferred embodiment, the first end 32‴ is preferably substantially horizontal and planar to support the container 14‴ on any generally horizontal planar surface.

The container second end 34‴ includes a guide ring portion 100‴ at the uppermost edge and a detente ring portion 102‴ immediately below the guide ring portion 100‴, the detente ring portion 102‴ being at the upper end of the sidewall 30‴. The container 14‴ is preferably formed of an elastomeric material which permits temporary expansion of the guide ring portion 100‴ and the detente ring portion 102‴ as shown by dashed line in FIG. 6.

A substantially planar closure member or cover 110‴ is provided for closing and sealing the container 14‴. A cover lip 112‴ around the periphery of the cover 110‴ engages and seats in the detente ring 102‴ to ensure that the container 14‴ is sealed. The detente ring portion 102‴, together with the guide ring portion 100‴, serves as a detente means to retain the cover 110‴. The cover 110‴ is provided with a handle 112‴ extending from the upper surface thereof for enabling the cover 110‴ to be engaged and disengaged from the detente ring 102‴.

A blending subassembly 120‴ extends downwardly from the cover 110‴ and into the interior of the container 14‴ when the cover 110‴ is secured to the container 14‴. The blending subassembly 120‴ includes a screen element 74‴ spaced away from and parallel to the cover 110‴. The screen element 74‴ includes a plurality of blending elements 122‴ disposed perpendicularly with respect to each other to form a cross-hatched screen element 74‴ having a plurality of apertures, as shown in FIG. 4, or alternatively disposed in a spaced, parallel relationship as shown in FIG. 2. A series of extenders 124‴ ensures that the screen element 74‴ is maintained in the desired spaced relationship with respect to the cover 110‴.

In operation, force is manually applied to the handle 112‴ by the user to cause expansion of the detente ring 102‴ and the guide ring 100‴ and thereby permit removal of the cover 110‴ from the container 14‴. As with the preferred embodiment, selected ingredients are then added to the interior of the container 14‴. The cover 110‴ is then replaced by reversing the steps of removal, with the screen element 74‴ being inserted into the interior of the container 14‴ as shown in FIG. 5. The user then lifts the container 14‴ by gripping the sidewall 30‴. By generating a relatively rapid up and down repetitive motion, the user caused the ingredients in the container 14‴ to pass repeated through the screen element 74'''. This action causes the mixing and blending of the ingredients by the blending elements 122''', and can be continued until a desired mixed or blended condition is attained. As with the preferred embodiment, the mixture passes through and incorporates a quantity of air during the mixing process. After this condition is attained, the cover 110''' may again be removed, to be replaced by an alternative cover not equipped with the blending subassembly 120''' (not shown) for permitting storage of the blended ingredients in the container 14'''.

Construction of the blending apparatus is believed best accomplished by the use of plastic components formed by injection molding. However, some use of metal may be desired for certain components such as handles 112 or blending elements 82 or 122. Furthermore, it will be understood by those skilled in the art that the components need not be secured together by interference fit, and that other securing means such as detentes or catches, or threaded screws, or other generally known means may be employed to positionally retain the components of the blending apparatus 10.

As can be seen, the blending apparatus 10 provides a simple and easily used means for preparing desired quantities of mixtures of dry, granular, or powdered ingredients. The blending apparatus 10 permits the advance preparation of these types of ingredients by enabling the ready storage of blended ingredients, thus providing substantial time savings during the preparation of goods including such ingredients. Furthermore, the advance preparation of such blended mixtures ensures the availability of the ingredients when their use is required, avoiding concerns of insufficiency of any particular ingredient. The blending apparatus 10 is also easily maintained and inexpensively manufactured.

The blending apparatus 10 also provides a substantially improved mixture, with the mixing process causing in the incorporation of a desired quantity of air into the mixture. This mixture, incorporating the blended air, substantially improves the texture of the finished food product. Furthermore, the blending apparatus ensures that the desired mixture, including blended air, is obtained at each use, insuring in turn that each resulting food product has the desired improved texture and consistency. Therefore, it can be seen that the blending apparatus 10 represents a useful and substantial improvement over the relevant prior art.

Modifications to the preferred embodiment of the subject invention will be apparent to those skilled in the art within the scope of the claims that follow:

What is claimed is:

1. A blending apparatus for mixing and blending dry and granular ingredients, said blending apparatus comprised of:

a container having a substantially planar first end, a container sidewall, and a second end: and a cover including a blending subassembly, said blending subassembly including a screen element spaced away from and parallel to said cover by an extender to extend into said container, said screen element further including a plurality of perpendicularly disposed blending elements, said cover selectively engageable with said container second end.

2. The blending apparatus as set forth in claim 1 wherein said container second end further includes a detente means for selectively and removeably securing said cover to said container.

3. A blending apparatus for mixing and blending dry and granular ingredients, said blending apparatus comprised of:

a container having a top portion and a bottom portion, said top portion having a first end, a top portion sidewall, and a top portion second end, said bottom portion further having a bottom portion first end, a bottom potion sidewall, and a bottom portion second end, said top portion further being selectively disengageable from said bottom portion, and said bottom portion being rotationally positionable with respect to said top portion;

a first screen element horizontally disposed in said top portion second end, said first screen element including a first blending element; and a second screen element horizontally disposed in said bottom portion second end, said second screen element including a second blending element in sliding engagement with said first screen element to selectively form an infinite variety of apertures in response to said positional rotation of said top portion and said bottom portion.

4. The blending apparatus as set forth in claim 3 wherein said top portion is rotationally positional with respect to said bottom portion during operation of the blending apparatus.

* * * * *